US007708433B2

(12) United States Patent
Korn

(10) Patent No.: US 7,708,433 B2
(45) Date of Patent: May 4, 2010

(54) LIGHT WITH PLASTIC HOUSING COMPRISED OF PLATES WITH GLUED BEVELED EDGES

(76) Inventor: Ralf Korn, Waldstr. 6/9, Meissenheim (DE) 77974

( * ) Notice: Subject to any disclaimer, the term of this patent is extended or adjusted under 35 U.S.C. 154(b) by 0 days.

(21) Appl. No.: 11/997,964

(22) PCT Filed: Aug. 16, 2006

(86) PCT No.: PCT/DE2006/001433

§ 371 (c)(1),
(2), (4) Date: Feb. 5, 2008

(87) PCT Pub. No.: WO2007/022753

PCT Pub. Date: Mar. 1, 2007

(65) Prior Publication Data

US 2008/0232117 A1 Sep. 25, 2008

(30) Foreign Application Priority Data

Aug. 26, 2005 (DE) ..... 20 2005 013 505 U

(51) Int. Cl.
*F21V 17/00* (2006.01)

(52) U.S. Cl. ..... 362/375; 362/362; 362/378; 362/368; 362/431; 362/353

(58) Field of Classification Search ..... 362/362, 362/378, 375, 147, 353, 363, 431
See application file for complete search history.

(56) References Cited

U.S. PATENT DOCUMENTS

| | | | | |
|---|---|---|---|---|
| 4,464,708 | A | 8/1984 | Nüssli et al. | |
| 6,328,457 | B1 * | 12/2001 | Huang | 362/353 |
| 7,314,293 | B2 * | 1/2008 | Steier et al. | 362/351 |
| 2001/0028568 | A1 | 10/2001 | Akiyama et al. | |
| 2004/0095764 | A1 * | 5/2004 | Tell et al. | 362/245 |
| 2005/0024856 | A1 | 2/2005 | Helenowski | |

FOREIGN PATENT DOCUMENTS

| | | | |
|---|---|---|---|
| CA | 1024962 | A1 | 1/1978 |
| DE | 20116765 | A1 | 3/2003 |

* cited by examiner

*Primary Examiner*—Sandra L O'Shea
*Assistant Examiner*—Jessica L McMillan
(74) *Attorney, Agent, or Firm*—Gudrun E. Huckett

(57) ABSTRACT

A light has a housing of plastic material and a light fixture that is arranged within the housing and that receives at least one light bulb. The housing is made from plates that each have outer edges that are beveled at an angle of 45 degrees and provide contact surfaces where the plates adjoin one another. The plates are glued to one another in the area of the contact surfaces over the entire surface area of the contact surfaces in such a way that the plates are joined flush without the outer edges projecting past one another. The housing has a bottom side provided with a circular cutout, wherein the light fixture projects through the circular cutout into the housing. A member is provided that releasably closes the circular cutout. The member is a base or a closure lid.

9 Claims, 10 Drawing Sheets

LIGHT WITH PLASTIC HOUSING COMPRISED OF PLATES WITH GLUED BEVELED EDGES

BACKGROUND OF THE INVENTION

The invention relates to a light comprising a housing of plastic material and at least one light bulb arranged within the housing by means of a light bulb fixture, wherein the housing is comprised of several plates and at least one plate is beveled at its outer edges at an angle of 45 degrees and glued to the adjoining plates in the area of its contact surfaces.

Such a light is disclosed in DE 81 28 057 U1. The light has housing sidewalls and a diffuser wall wherein the diffuser wall and the adjoining housing sidewalls are connected to one another similar to a miter joint. The edges that are resting against one another are glued together. The housing sidewalls are comprised of transparent plexiglass but they are provided with a reflective layer and a black cover coating so that no light can penetrate to the exterior. In this way, an improved illumination of the diffuser wall is achieved; disadvantageously, a high-quality visual appearance is however not achieved.

A further known light comprises a housing that is produced integrally by a casting process. This provides for an inexpensive manufacture but, disadvantageously, a high-quality visual appearance is not achieved.

The object of the invention is thus viewed in further developing the light of the aforementioned kind such that a special visual and aesthetically pleasing appearance is achieved.

SUMMARY OF THE INVENTION

As a solution to this object, it is proposed according to the invention that for a light of the aforementioned kind all plates at their outer edges are beveled at an angle of 45 degrees and adjoining plates are glued together in the area of their contact surfaces over the entire surface area wherein at the bottom side of the housing a circular cutout is provided that can be closed off by a base or a closure lid through which opening the light bulb fixture projects into the housing.

It has been found that for a light according to the invention the edges of the housing in the area of the contact surfaces appear brighter than the other areas of the housing sidewalls. In this way, the shape of the housing is especially enhanced for the viewer and an extraordinary visual appearance will result. This impression is further enhanced when the plates are made of plexiglass with at least one satin-finished surface. By means of a satin-finished surface on one or both faces of the plexiglass, a very soft and pleasing light distribution is generated wherein, in turn, the edge areas of the housing will shine more brightly and in this way the exact shape of the housing stands out. When the light is illuminated by sunlight, the light beams are reflected in the entire housing and the viewer has additionally the impression that the light is switched on. Moreover, when using colorless satin-finished surface plexiglass one cannot view the interior of the housing from the exterior so that within the housing the light bulb is not visible and therefore the clear impression of the exact shape of the housing is not diminished. At one side of the housing, particularly the bottom side, a circular cutout is provided. The cutout is closed by a base or a closure lid. The light fixture projects such into the housing that the light bulb is arranged approximately at the center of the housing so that a uniform illumination and an enhancement of the visual effect is achieved. By means of the closure lid the light can be positioned at different locations in a simple and fast way and also in a visually pleasing way.

The light according to the invention is preferably parallel-epipedal or cubic and can be positioned e.g. outdoors in different ways. One embodiment of the invention provides that on the bottom side of the housing a base is arranged. The base can be in cross-section rectangular or circular. The light bulb fixture can be arranged on the top side of the base and can project through the housing opening into the housing. A further embodiment of the invention proposes that on the bottom side of the housing a multifunctional closure lid is arranged. On this closure lid, advantageously a ground spike can be arranged with which the light can be mounted with minimal expenditure on the ground. According to a further embodiment of the invention, on the closure lid alternatively a fastening plate is arranged that is suitable for attaching the light to a ceiling or a flagstone. The closure lid is also suitable for receiving thin steel cables so that a flexible suspension, for example, from the ceiling or from a lamp post is possible.

BRIEF DESCRIPTION OF THE DRAWINGS

The invention will be explained in the following with the aid of the drawing. The drawing shows embodiments of the invention. It is shown in.

DESCRIPTION OF PREFERRED EMBODIMENTS

Figure 1:
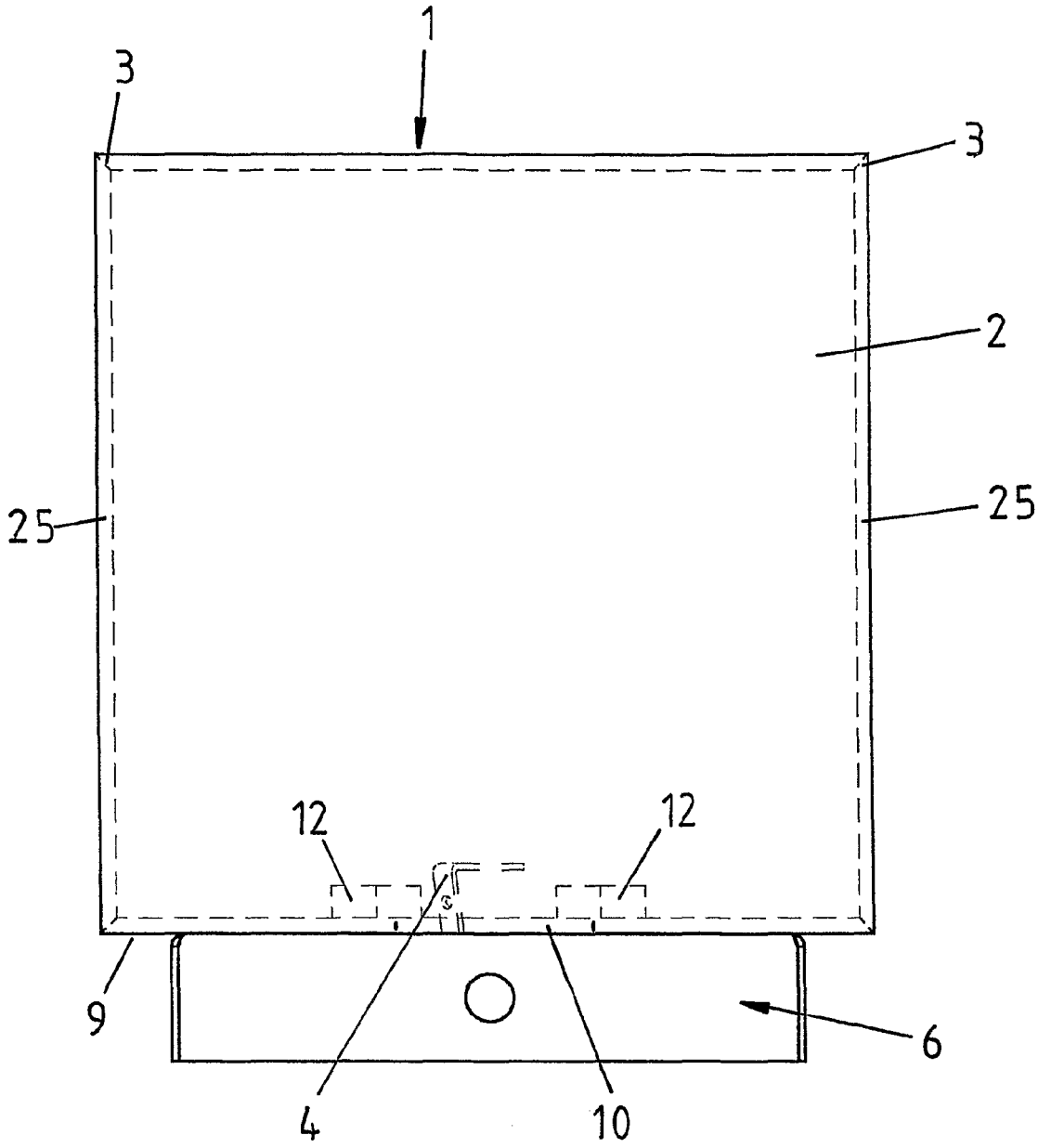
FIG. 1 a side view of the light according to the invention with a base.
Figure 2:
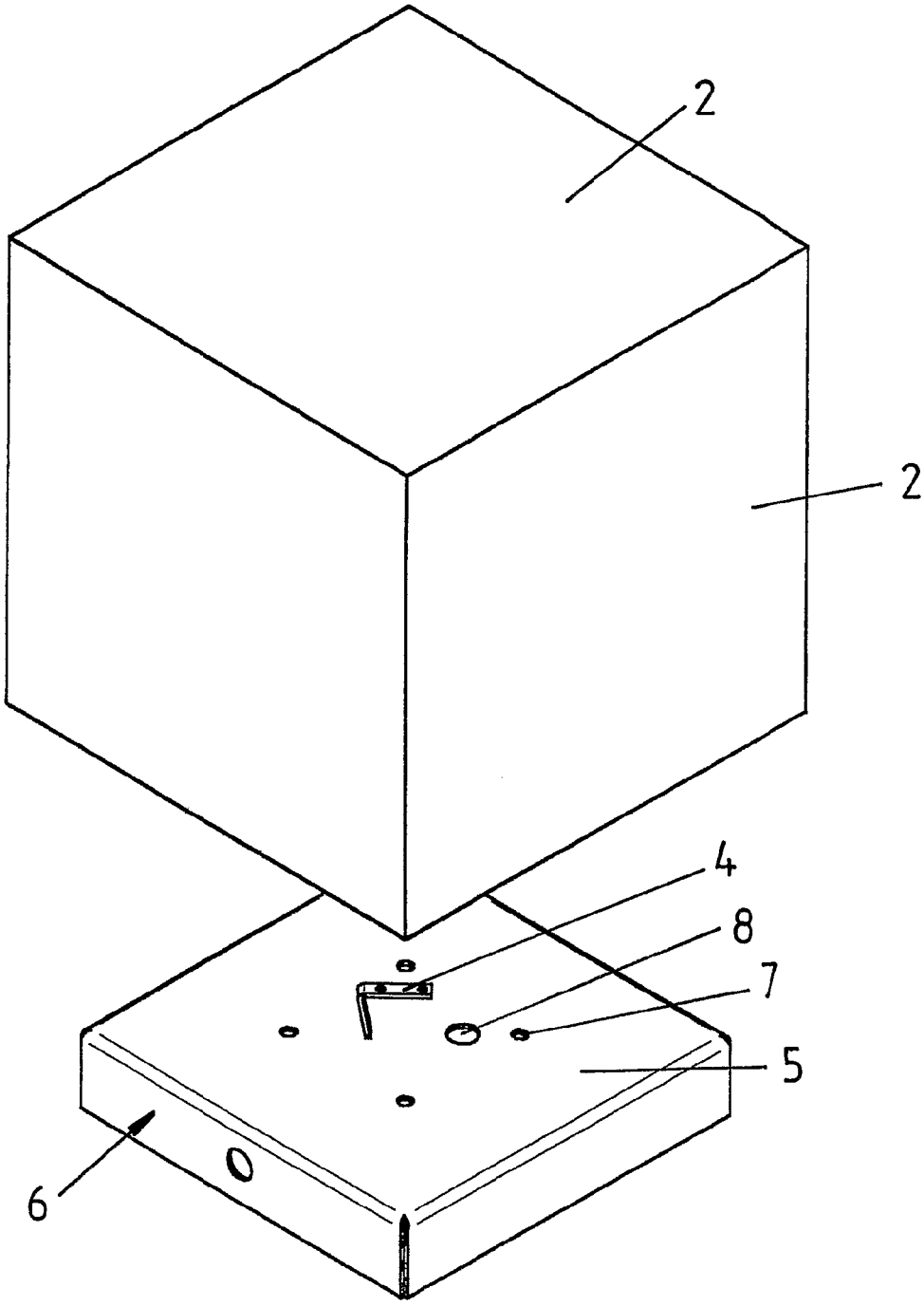
FIG. 2 an exploded view according to FIG. 1.

The light according to the present invention illustrated in FIG. 1 has a cubic housing 1 of plastic material that is comprised of several plates 2. Each plate 2 is beveled or milled at its outer edges 3 at an angle of 45 degrees relative to its outer surface such that the adjoining plates 2 are joined without seam and projections when the housing 1 is assembled. The plates 2 are glued together in the area of the contact surfaces of adjoining plates 2 that correspond to the surface of the outer edges 3. A suitable glue is applied to the entire surface area of the contact surfaces or outer edges 3. Each plate 2 is comprised of plexiglass with satin-finished surfaces on both faces. Conceivable are also matt-finished surfaces. The plexiglass has distributed about its volume a plurality of small diffusing pearls on which light is reflected. A total of six plates 2 that are square in cross-section are glued together to form the housing illustrated in FIG. 1. Within the housing 1 a light bulb, not shown in detail in the drawing, is mounted on the light bulb fixture 4. The light bulb fixture 4 is attached to a top side 5 of a base 6 that is rectangular in cross-section. The base 6 is formed as a hollow body that is open in the downward direction wherein its top side 5 has four bores 7 for fastening screws and has a somewhat greater bore 8 for passing electric cables therethrough. On the bottom side 9 of the housing 1 a circular cutout lOis provided through which the light bulb fixture 4 projects into the housing 1. A circular groove 11 extends circumferentially about the cutout 10. Into the groove 11 an O-ring is inserted so that the interior of the housing 1 is water-tightly sealed and in particular the light bulb is protected from water when the base 6 is screwed on. The screw nuts 12 for the fasting screws are schematically indicated in dashed lines in FIG. 1 as are all parts or edges arranged inside the housing 1.

Figure 3:
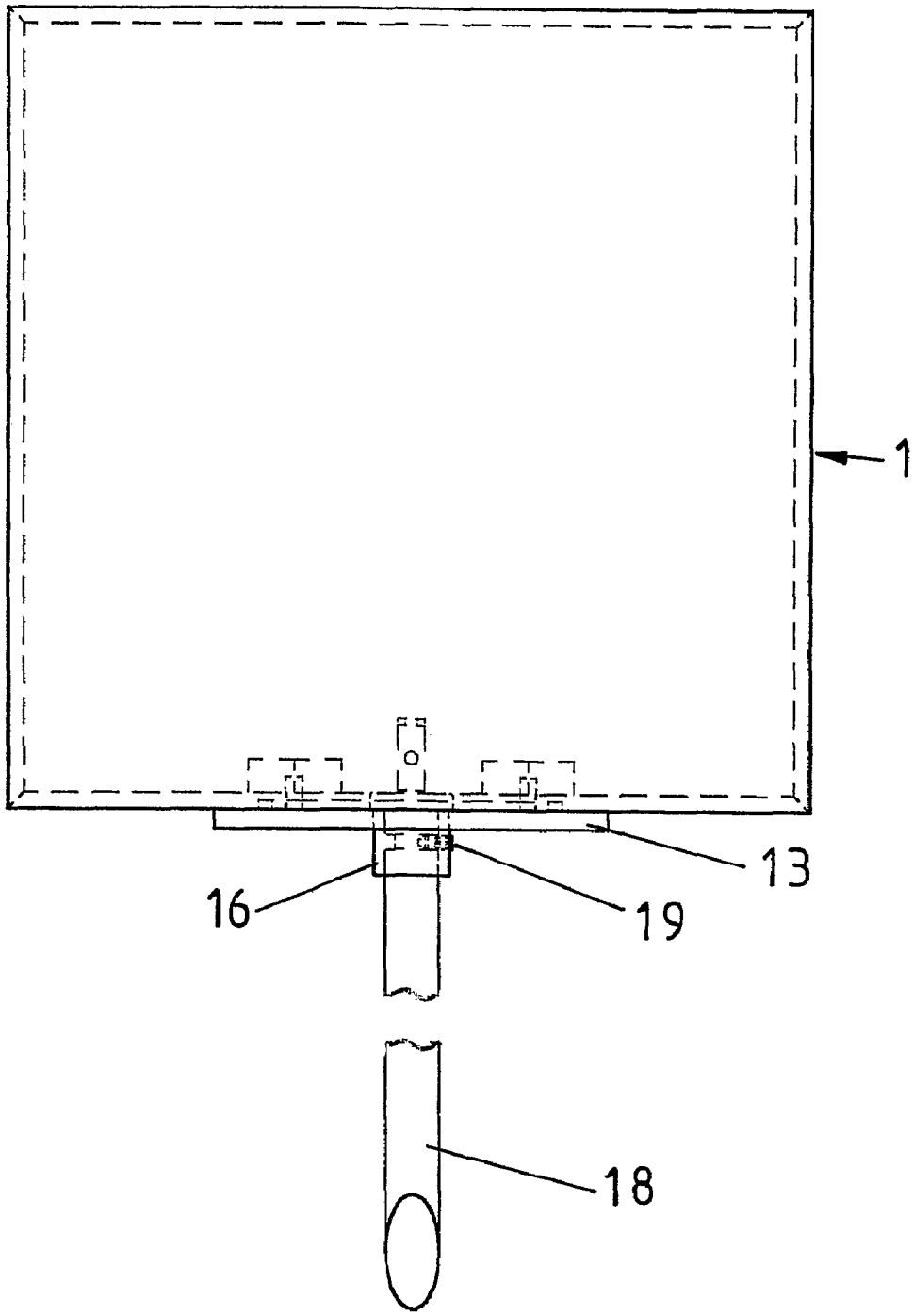
FIG. 3 the light according to the invention with a ground spike, partially broken away.
Figure 4:
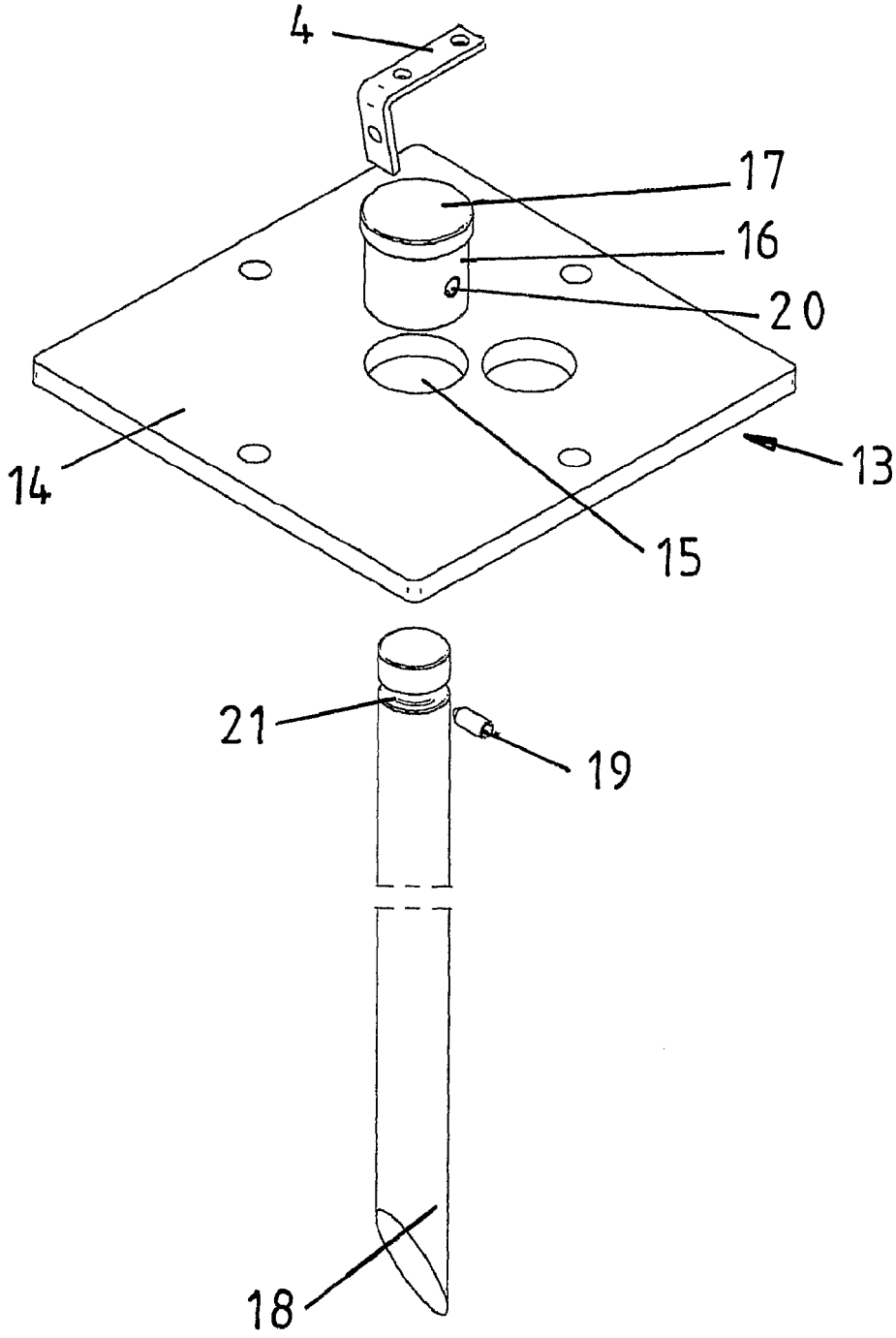
FIG. 4 an exploded view according to FIG. 3 without a housing.

In the embodiment according to FIG. 3, a multifunctional closure lid 13 is attached instead of the base 6 to the bottom side 9 of the housing 1. This closure lid 13 is comprised of a metal plate 14 that is square in cross-section and has centrally a throughbore 15 into which a cylindrical body 16 is inserted. The hollow body 16 is closed off toward the interior of the housing 1 by a disk 17 and is open downwardly and toward the exterior in such a way that a ground spike 18 in the form of a pointed metal pipe or a metal rod can be inserted. The hollow body 16 is welded to the metal plate 14 and the ground spike 18 is attached by means of a pin 19 to the hollow body 16. For this purpose, the pin 19 is inserted through a bore 20 into the jacket of the hollow body 16 and the pin 19 is locked in a circumferential groove 21 on the ground spike 18. By means of the ground spike 18 the light can be fastened in a simple way on the ground. Depending on the type of ground the ground spike can be designed for hard or soft ground. Instead of a metal tube as a ground spike 18, it is also possible to use a profiled rod.

Figure 5:
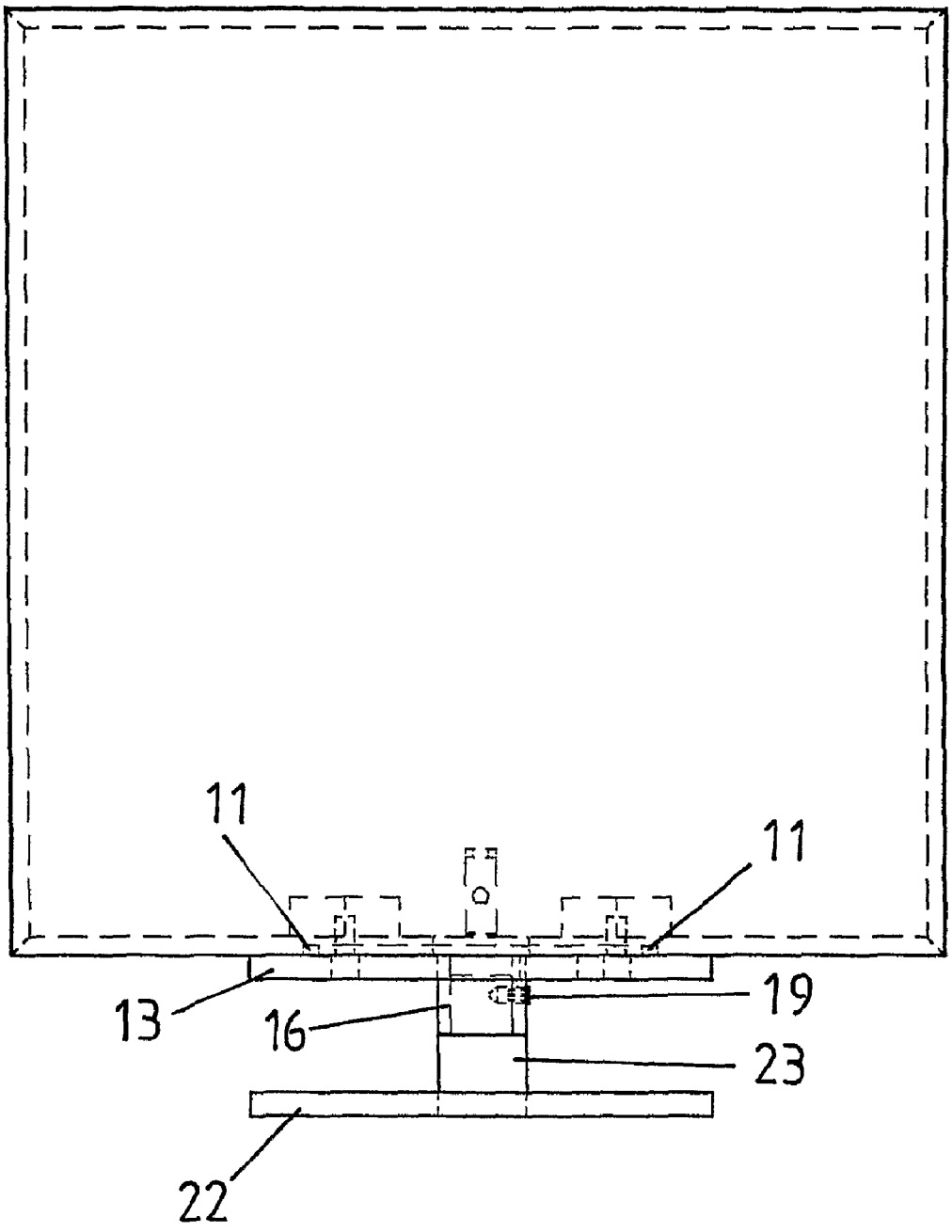
FIG. 5 the light according to the invention with a fastening plate.
Figure 6:
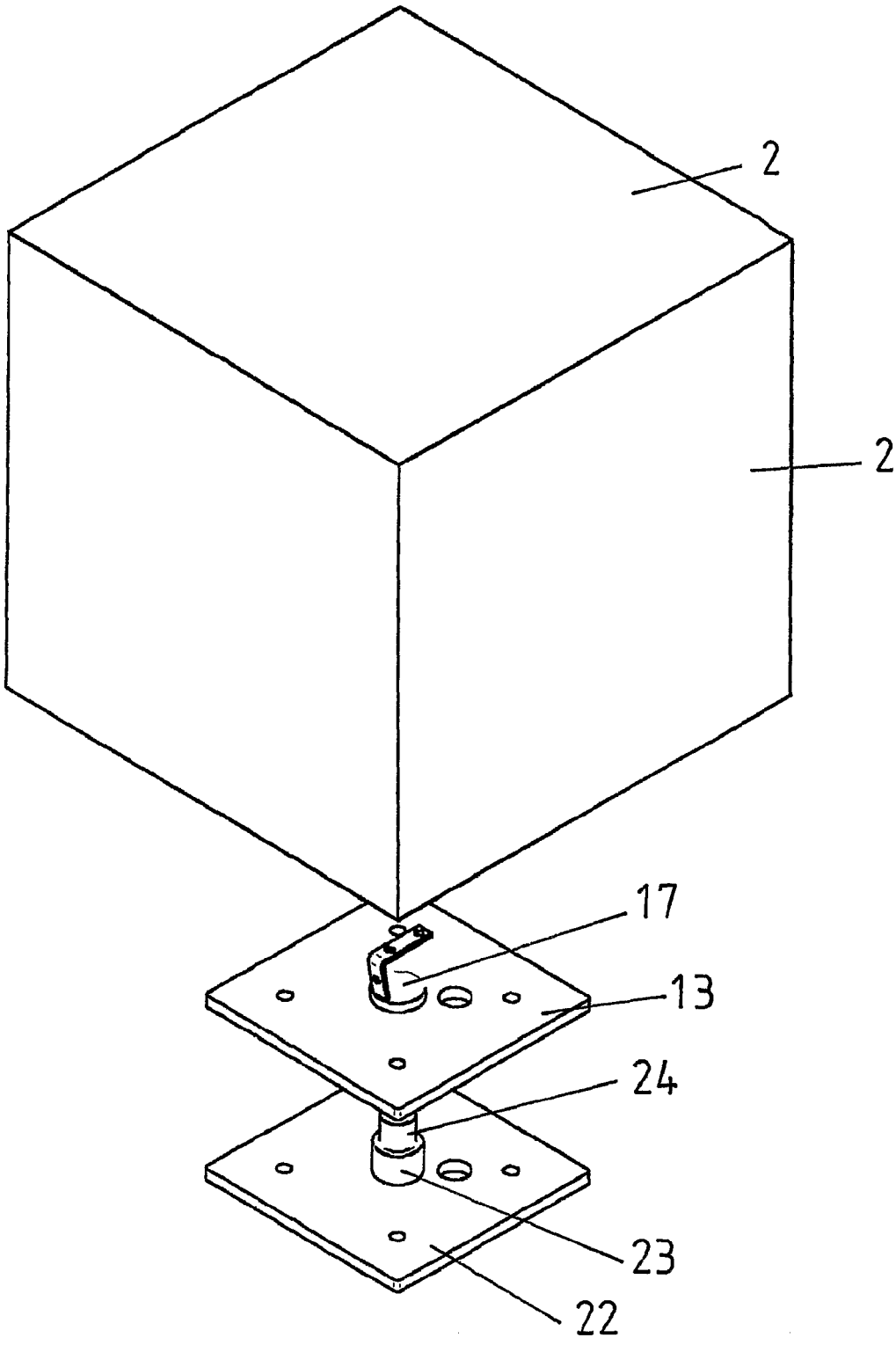
FIG. 6 an exploded view according to FIG. 5.

When the light according to the invention is to be attached for example to a ceiling or a flagstone, instead of the ground spike 18 a fasting plate 22 is inserted into the hollow body 16 of the closure lid 13 as illustrated in FIG. 5. The fastening plate 22 is comprised of metal, is of a square configuration, and has centrally a cylinder-shaped projection 23 that is stepped once with regard to its diameter. The area 24 of the projection 23 that has the smaller diameter is positioned within the hollow body 16 after assembly and is also attached by means of the pin 19 to the hollow body 16.

Figure 7:
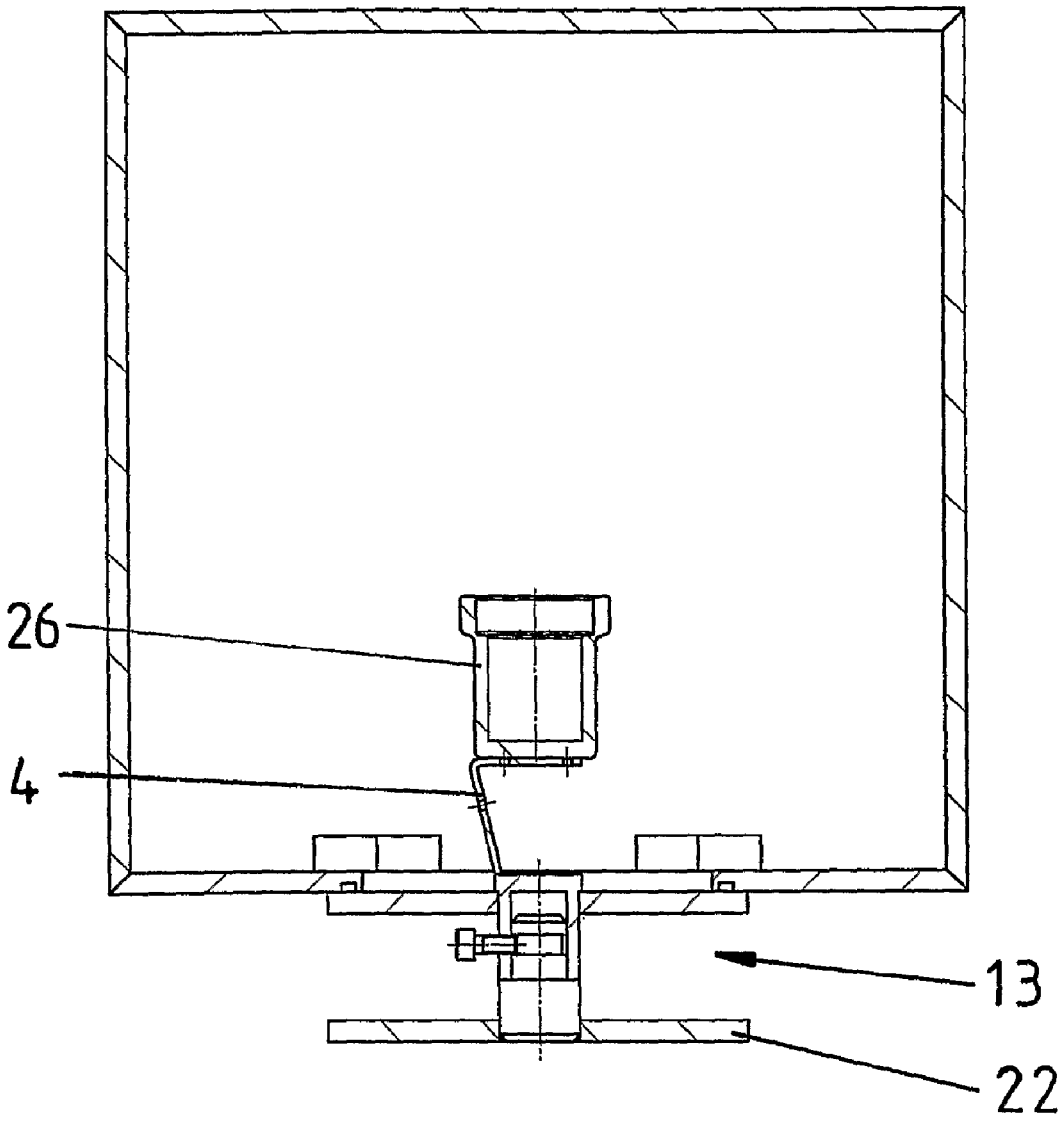
FIG. 7 a cross-section of the light according to FIG. 5 with threaded light bulb fixture.
Figure 8:
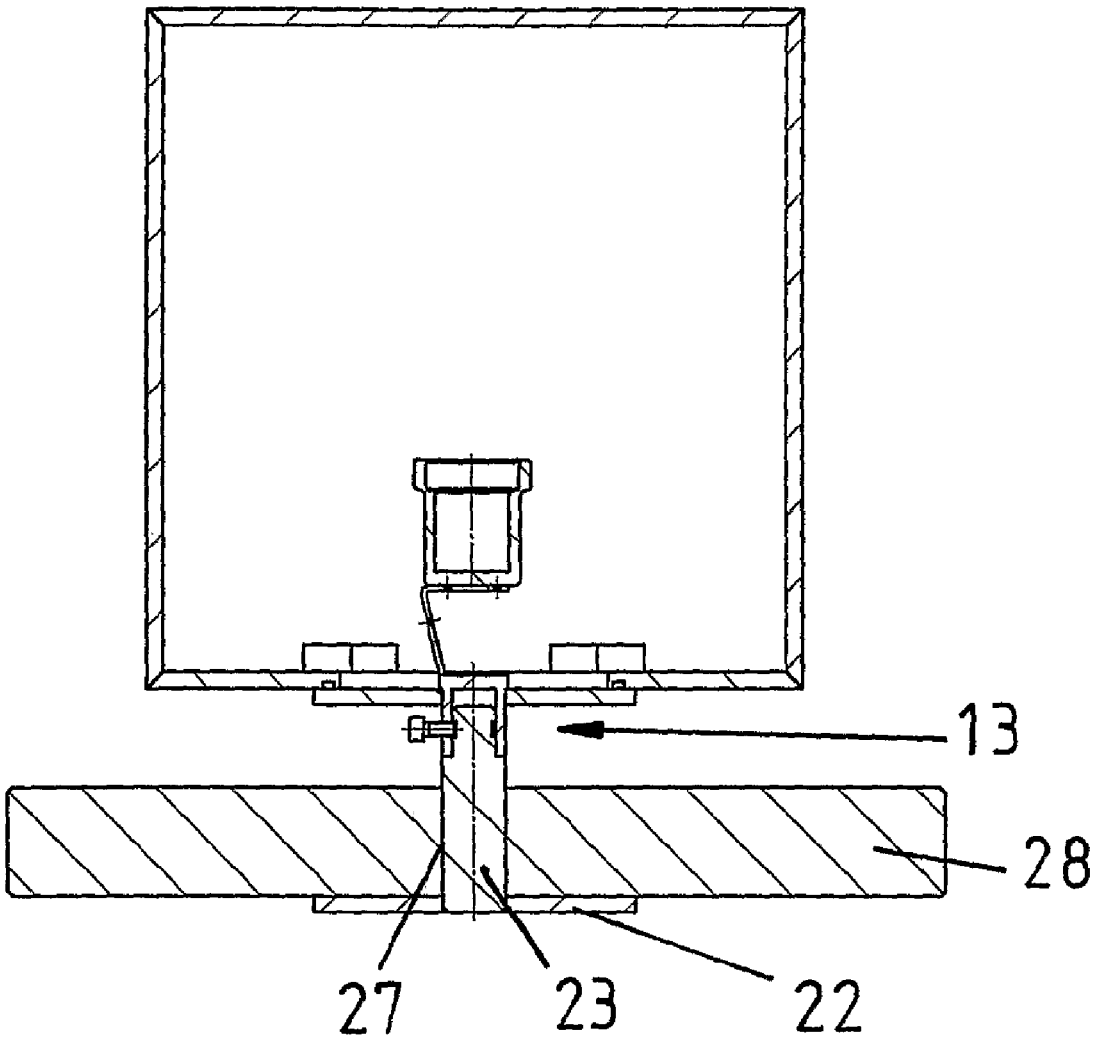
FIG. 8 a cross-section of a further light.

In the light illustrated in FIG. 7 the actual threaded fixture 26 for the light bulb is illustrated on the light bulb fixture 4. The light can be mounted by means of the fastening plate 22 directly to a top face of a wall. The fastening plate 22 can also be pushed with its projection 23 through the bore 27 of a flagstone 28 and then be screw-connected to the multifunctional closure lid 13 as described above. In the case of this light, the fastening plate 22 is then arranged at the bottom side of the flagstone 28 and must not be screwed to the flagstone 28 itself; this is shown in FIG. 8.

Figure 9:
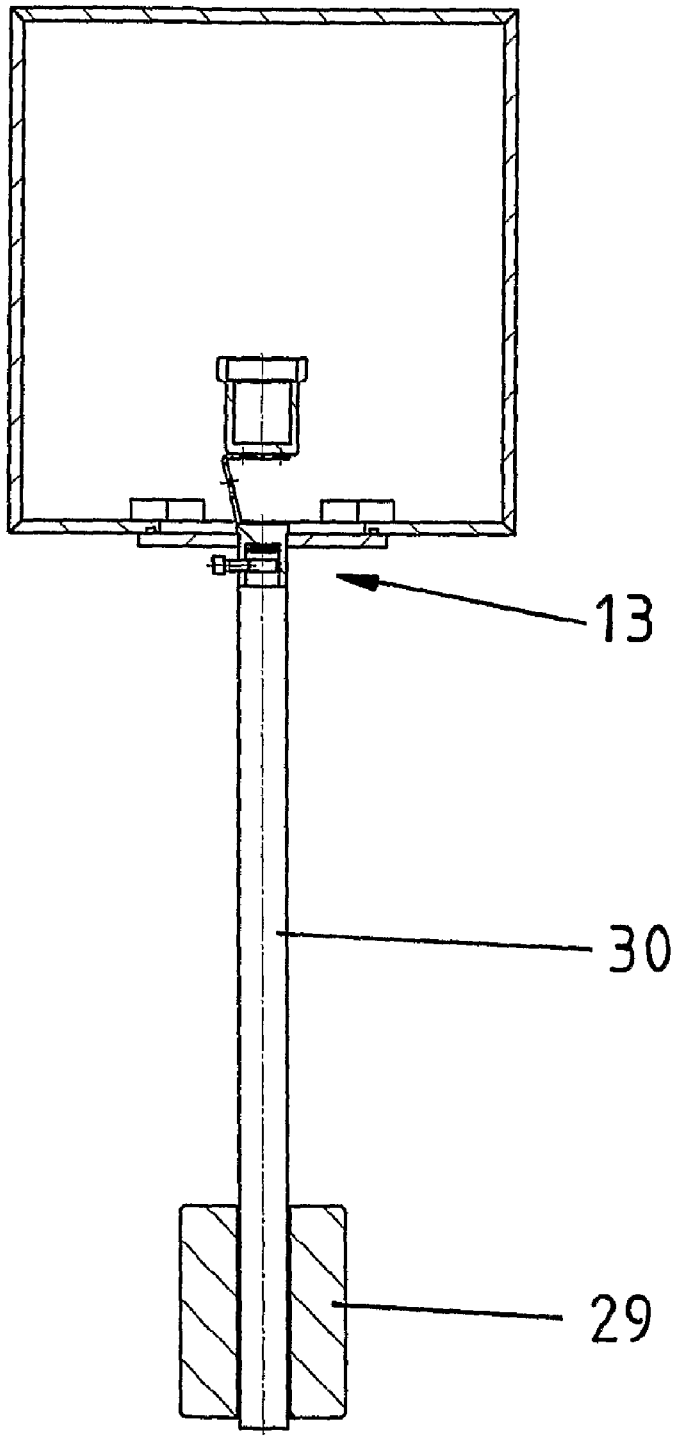
FIG. 9 a cross-section of a further light with a float for water surfaces.

The light illustrated in FIG. 9 is used on water surfaces and floats on the water surface. For this purpose, a float 29 is provided that is arranged at the bottom end of a metal pipe or plastic pipe 30. This pipe 30 is inserted into the closure lid 13 as described above in connection with the ground spike 18. The interior of the light is water-tight by means of the O-ring in the groove 11, welding of the hollow body 16 to the metal plate 14, and gluing of the plates 2.

Figure 10:
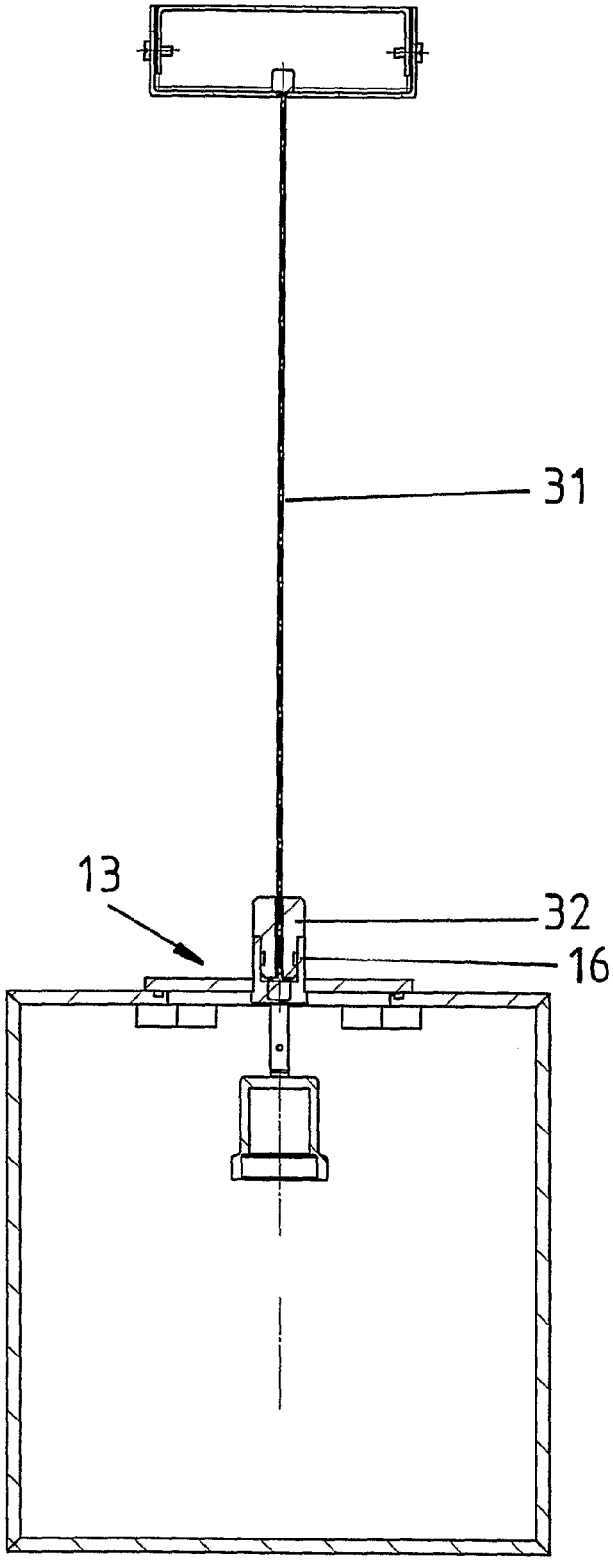
FIG. 10 a cross-section of a further light suspended from the ceiling.

The light illustrated in FIG. 10 is attached to a ceiling wherein a fastening wire or fastening cable 31 is connected to a holder 32 that is fastened in the hollow body 16 of the closure lid 13. The light can be attached to a wall by means of the closure lid 13 and a wall amount.

When operating the light, the light of the light bulb is reflected on the plates 2 and in the area of the outer edges 3 in such a way that the edge areas 25 of the housing 1 appear brighter than the outer surfaces of the plates 2. In this way, the special shape of the light, in this case the cubic shape, is particularly underscored and enhanced so that for a viewer a special visual effect is provided. Moreover, by means of the satin-finished surfaces of the plates 2, a very soft and pleasing light distribution is generated for the viewer. By means of the closure lid, the light can be simply and quickly installed at different locations and in a visually pleasing way.

What is claimed is:

1. A light comprising:

a housing of plastic material;

a light fixture arranged within the housing and receiving at least one light bulb;

wherein the housing is comprised of plates, wherein the plates each have outer edges that are beveled inwardly at an angle of 45 degrees toward an interior of the housing so as to form contact surfaces where the plates adjoin one another, wherein the contact surfaces are glued to one another over the entire surface area of the contact surfaces in such a way that the plates are joined flush without the outer edges projecting past one another and wherein the contact surfaces appear brighter than a remainder of the plates and visually enhance an outline of the housing;

wherein the housing has a side provided with a circular cutout, wherein the light fixture projects through the circular cutout into the housing;

wherein a groove with an O-ring is provided that extends circumferentially about the circular cutout;

a closure lid that releaseably closes the circular cutout;

wherein the closure lid comprises a metal plate and a hollow body and wherein the hollow body is welded to the metal plate, wherein the hollow body is closed off toward the interior of the housing by a disk and is open in opposite direction toward the exterior of the housing;

wherein the interior of the housing is water-tightly sealed by the closure lid;

wherein the closure lid is a multifunctional closure lid comprising means for attaching a mounting device, wherein the means for attaching comprise a bore in a jacket of the hollow body and a pin inserted through the bore for engaging the mounting device inserted into the hollow body.

2. The light according to claim 1, wherein the plates are comprised of plexiglass and each have at least one satin-finished surface.

3. The light according to claim 1, wherein the housing is parallelepipedal or cubic.

4. The light according to claim 1, wherein the closure lid is arranged on a bottom side of the housing.

5. The light according to claim 4, wherein the mounting device is a ground spike attached to the hollow body by the pin.

6. The light according to claim 4, wherein the mounting device is a fastening plate attached to the hollow body by the pin.

7. The light according to claim 4, wherein the mounting device is a float means attached to the hollow body by the pin.

8. The light according to claim 1, wherein the mounting device is a ground spike, a float means, a fastening plate for mounting to a ceiling or a floor, or a holder for attaching a thin steel cable for suspending the light.

9. The light according to claim 1, wherein the mounting device is a holder for attaching a thin steel cable for suspending the light wherein the holder is attached to the hollow body by the pin.

* * * * *